US005337860A

United States Patent [19]

Burke et al.

[11] Patent Number: 5,337,860

[45] Date of Patent: Aug. 16, 1994

[54] RAILROAD WHEEL FLANGE LUBRICATOR MOUNTING

[76] Inventors: Robert J. Burke, Rte. 4, Box 255B, Ellensburg, Wash. 98926; Paul J. Weber, 4401 Webster, Yakima, Wash. 98908

[21] Appl. No.: 44,583

[22] Filed: Apr. 7, 1993

[51] Int. Cl.[5] ..... B61K 3/00

[52] U.S. Cl. ..... 184/3.2; 184/99

[58] Field of Search ..... 184/3.1, 3.2, 98, 99

[56] References Cited

U.S. PATENT DOCUMENTS

| | | | |
|---|---|---|---|
| 981,597 | 1/1911 | Noble | 184/3.2 |
| 1,060,174 | 4/1913 | Feeney | 184/3.2 |
| 2,055,939 | 9/1936 | Miller . | |
| 2,082,414 | 6/1937 | Munford . | |
| 2,116,249 | 5/1938 | Munford . | |
| 2,704,137 | 3/1955 | Stidd . | |
| 3,944,025 | 3/1976 | Owen . | |
| 4,162,652 | 7/1979 | Rebel et al. . | |
| 4,393,957 | 7/1983 | Hawthorne . | |
| 4,711,320 | 12/1987 | Dombroski et al. . | |
| 4,726,448 | 2/1988 | Schroeder et al. . | |
| 4,736,818 | 4/1988 | Wolfe . | |
| 4,811,818 | 3/1989 | Jamison . | |
| 4,834,218 | 5/1989 | Dombroski et al. . | |
| 4,895,408 | 1/1990 | Wiebe . | |
| 4,915,195 | 4/1990 | Dial . | |
| 4,930,600 | 6/1990 | Kumar et al. . | |
| 5,054,582 | 10/1991 | Aracil | 184/3.2 |
| 5,085,292 | 2/1992 | Dial . | |

FOREIGN PATENT DOCUMENTS

| | | | |
|---|---|---|---|
| 0468903 | 11/1928 | Fed. Rep. of Germany | 184/3.2 |
| 2823865 | 5/1979 | Fed. Rep. of Germany . | |
| 465243 | 8/1951 | Italy . | |
| 536077 | 1/1977 | U.S.S.R. . | |
| 0117246 | 7/1918 | United Kingdom | 184/3.2 |
| 2019798 | 11/1979 | United Kingdom . | |

*Primary Examiner*—Thomas E. Denion

*Attorney, Agent, or Firm*—Stratton Ballew Richardson

[57] ABSTRACT

A mounting for applying lubrication to the flanges of locomotive truck wheels comprising bearing brackets attached to the journal boxes at either end of an axle and projecting upward therefrom, a hinge plate rotatably attached to the top of each bearing bracket, a floating arm rotatably attached at each of its ends to the top of the hinge plates, and a lubrication stick applicator with lubrication stick attached to each end of the floating arm with the lubrication stick in contact with the flange of each of the wheels on the axle.

1 Claim, 4 Drawing Sheets

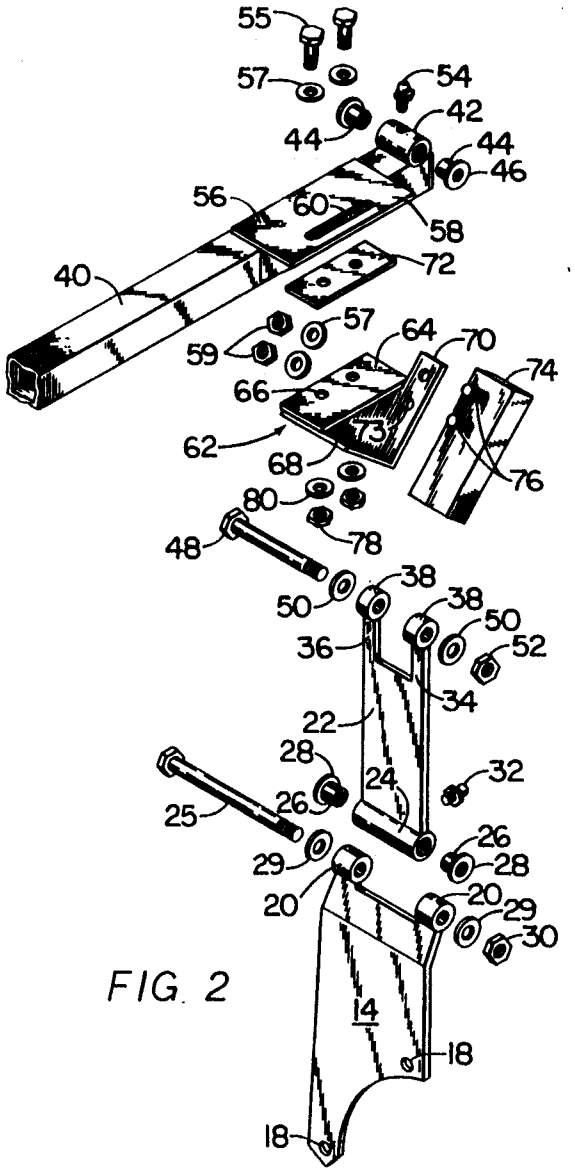
FIG. 2
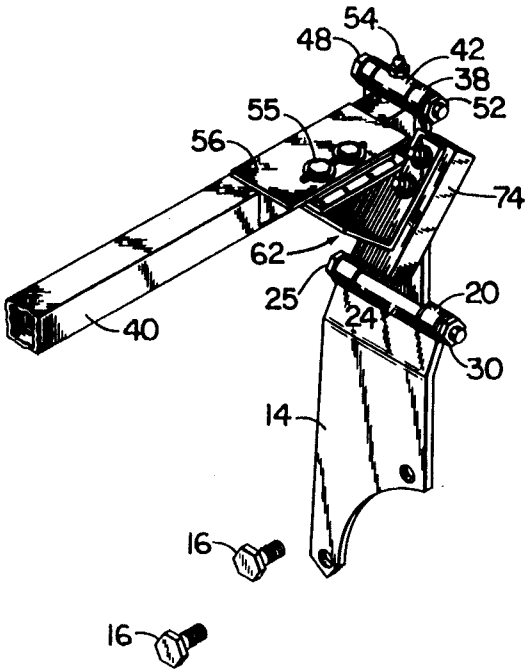
FIG. 3
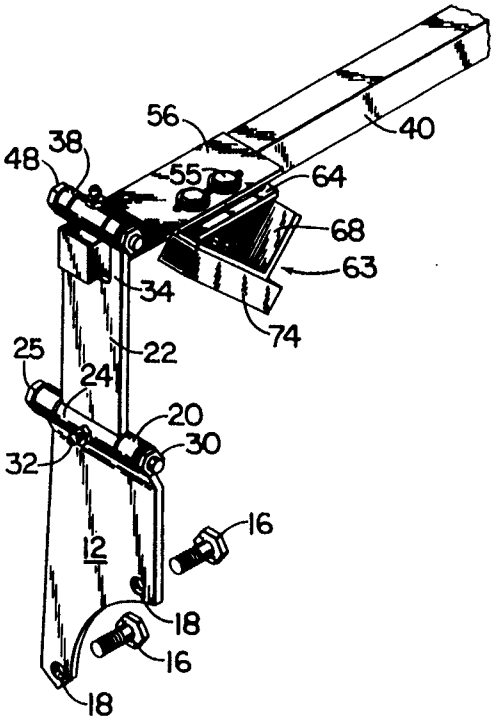

RAILROAD WHEEL FLANGE LUBRICATOR MOUNTING

BACKGROUND OF THE INVENTION

It has been demonstrated through testing and implementation that the use of wheel flange lubrication on rail vehicles saves fuel and reduces wheel and rail wear.

Many systems for applying flange lubrication have been designed, patented and marketed. Few of these systems have been shown to be reliable. To the inventors' knowledge, no on-board flange lubrication system has had success and acceptance in mainline freight application.

A flange lubricator system, regardless of the type of lubricant being used, must consistently place a proper amount of lubrication in the "crotch" of the flange—that is, in the area where the flange meets the wheel tread.

There has been some success in using on-board solid block lubricant systems in rail transit application, and some limited success in using stick lubricants in freight switch applications.

The freight railroad environment is a harsh and unforgiving world. Freight railroads desire a lubrication system that places no limitation on operations. They also desire a system which costs less to install and maintain than it might cost for the increased fuel consumption, wheel wear and track maintenance without lubrication. Some of the previous on-board designs have not been considered for use by freight railroads because they place restrictions on operations and, more commonly, would not survive in service for even a short time.

The lubrication system disclosed in this application is designed to be compatible with the operations of a mainline railroad, and is designed to apply accurately solid block lubricants in a precise manner with little maintenance.

On-board flange lubricant systems can be grouped into two categories: sprung and unsprung. Unsprung systems must endure great vibration without failing, and sprung systems must be able to follow accurately the vertical movement of the unsprung flange. Many on-board lubrication designs have failed to address the fact that many railroad wheel assemblies also have lateral movement with respect to the bearing journals or roller bearings.

The system disclosed herein applies solid block lubricant to the lead axle flanges and to the trailing axle flanges of four-axle and six-axle locomotives. As the lubricated wheel rotates, the lubricant is transferred to the gage face of the rail, when contact is present, as in a curved portion of track. Research and testing have shown that the lubricant is then "carried" back to the following wheels of the train. On tangent track lubricant is essentially not transferred due to very little flanging effect. The lubricant blocks are designed to maintain a specified lubricant "stripe" on the flange and, if the lubricant is not transferred to the rail, the block merely rides on the lubricant already present.

This system is to be used on locomotives which use the Hyatt roller bearing journal. The Hyatt roller bearing is used on the majority of freight locomotives in North America. The Hyatt bearing system is designed to permit lateral play in the wheel-axle assembly. Our unsprung system mounts on the inner cover plate of the Hyatt journal box. A floating arm is incorporated to follow the lateral motion of the wheel-axle assembly. The system of this invention is compatible with the operation of a mainline railroad, and is designed to apply accurately solid block lubricants in a precise manner with little maintenance.

SUMMARY OF THE INVENTION

An upward extending bearing bracket is bolted to the inner side of each of the journal boxes on opposite ends of the front axle, using two of the journal box cover plate bolts to secure the bracket in place. A hinge plate, which also extends upwardly, is rotatably attached to the upper end of each of the bearing brackets. A floating arm extending transversely is rotatably attached to the upper ends of the hinge plates, and connects the two hinge plates. An attachment plate is welded to the floating arm near each end thereof. The attachment plate extends outwardly from the floating arm. The outward extension has a slot running parallel to the floating arm. An applicator adaptor, which is triangular in shape, is bolted to the bottom of the attachment plate. A shim plate may be used between the applicator adaptor and the attachment plate. A lubrication stick applicator is attached to the outward angular leg of the applicator adaptor. Within the lubrication stick applicator is a coiled spring which urges the lubrication stick against the crotch between the flange and the wheel tread.

BRIEF DESCRIPTION OF THE DRAWINGS

FIG. 2 is an exploded view of the parts forming the mounting assembly on the left side of the truck.

FIG. 3 is a perspective view from the right side of the entire mounting assembly.

DETAILED DESCRIPTION OF THE INVENTION

Figure 1:
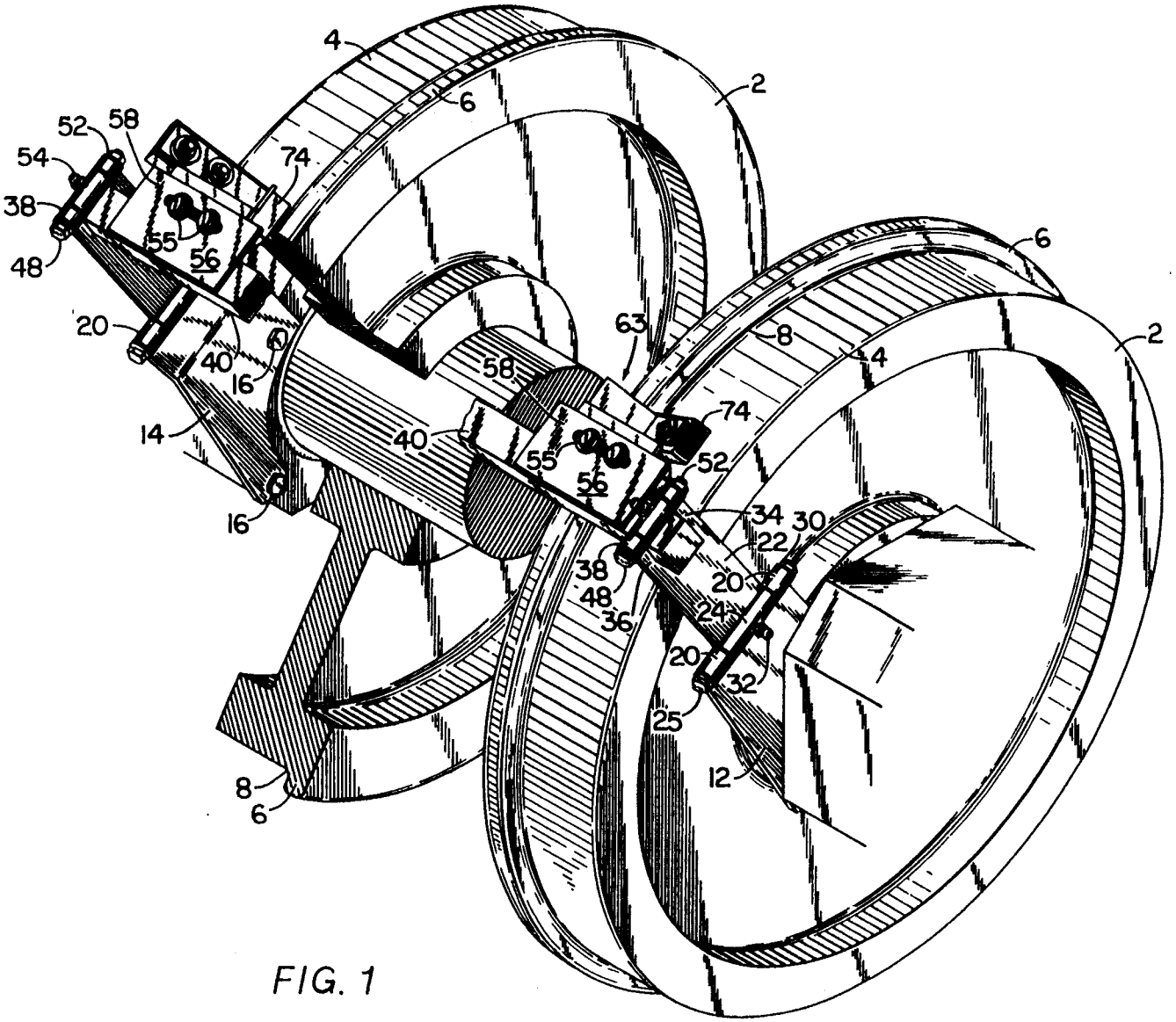
FIG. 1 is a perspective view, partially broken away, of the entire mounting as applied to the journal box and the wheel-axle assembly.
Figure 4:
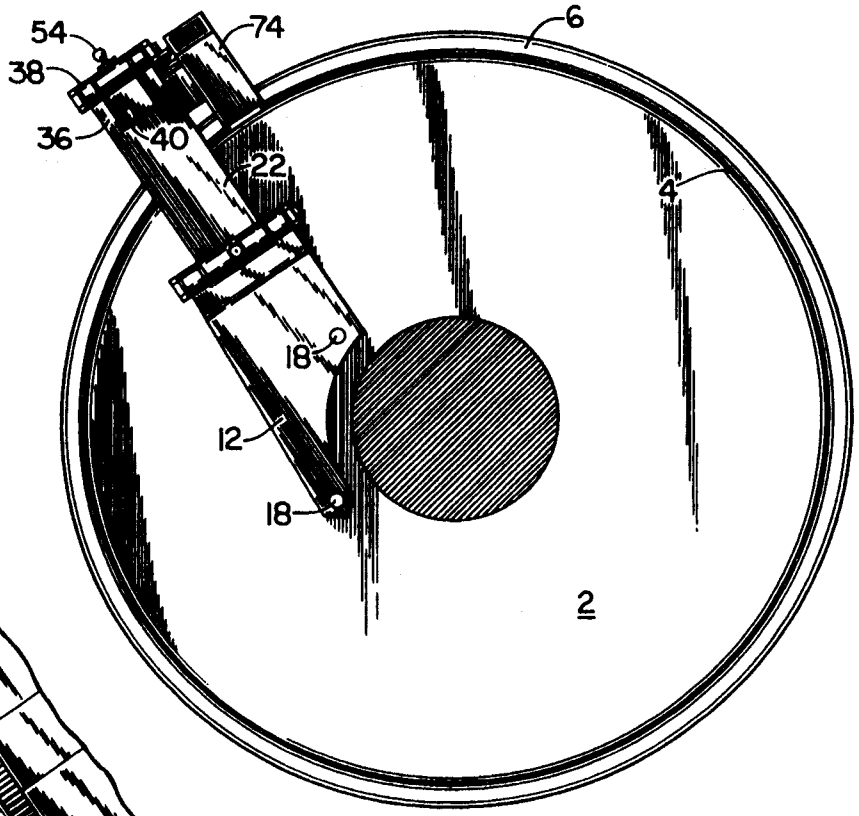
FIG. 4 is a side elevation of the left side of the mounting assembly.
Figure 5:
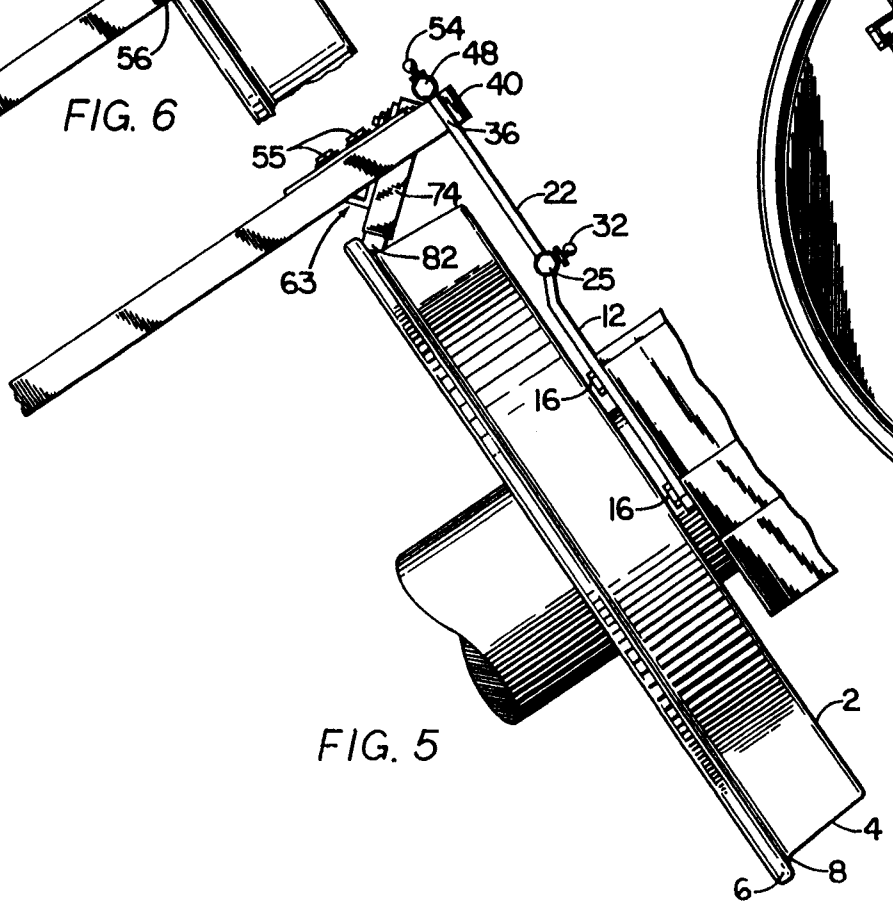
FIG. 5 is a front elevational view of the left side of the mounting assembly.
Figure 6:
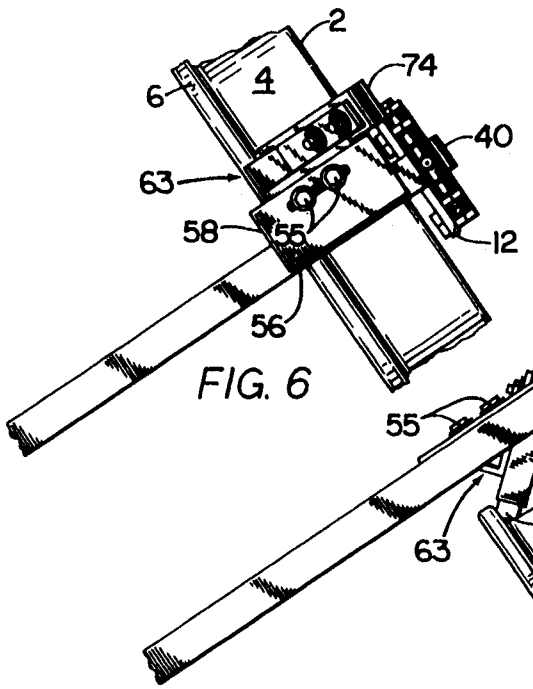
FIG. 6 is a plan view of the left side of the mounting assembly.
Figure 7:
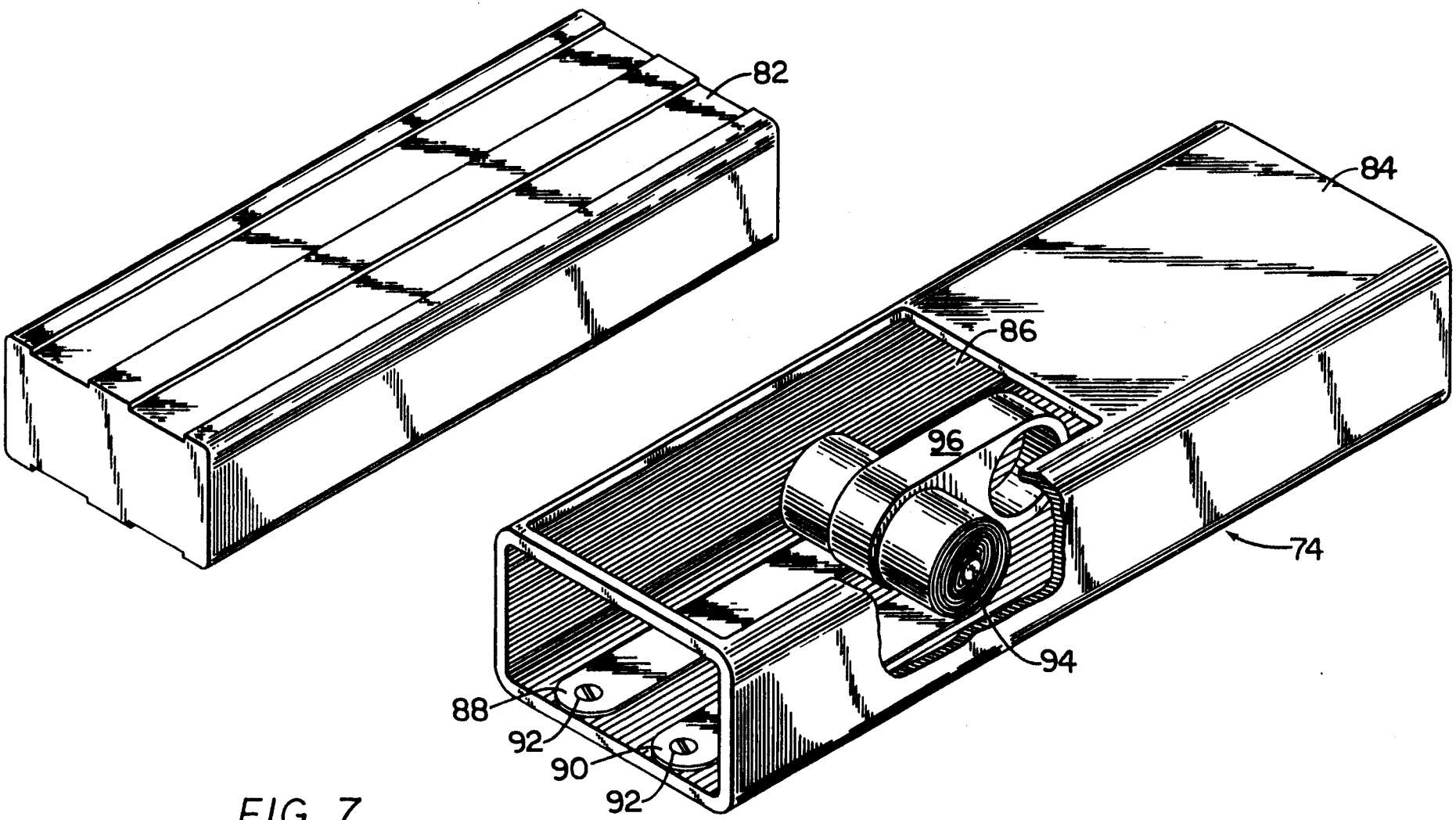
FIG. 7 is a perspective view of a lubricator stick and a lubricator stick applicator.

The railroad engine truck assembly comprises, in part, journal boxes outboard of each wheel. On the inner side of each journal box there is a cover plate facing each wheel. The axle extends through each wheel, and through the cover plate, into the journal box where roller bearings are located. There is a small amount of lateral play between the axle and the roller bearings. The wheel 2 has a tread 4 which is slightly tapered, a flange and a crotch 8 between the tread 4 and the flange 6.

The lubricator mounting system comprises assembled parts, some of which are necessarily mirror images of each other because of being located on opposite sides of the truck as parts of the mounting support system. The parts are connected by a floating arm which is attached only to the lubricator mounting system and not to the truck.

Bearing brackets 12 and 14, which are mirror images of each other, are mounted on the journal box cover plates (not shown) using two of the cover plate bolts 16 to hold them in place. Each bearing bracket 12 and 14 has an arcuate cutout forming its lower end. Bolt holes 18 are provided near the edge of the arcuate section for attachment to the journal box cover plate. At each upper corner of each bearing bracket 12 and 14 is a cylindrical section 20 forming part of a hinge. Each bearing bracket 12 and 14 is bent in an outboard direction near its upper end.

The hinge plates 22 are identical and each is a plate having a cylindrical element 24 across its entire lower end. Bearing elements 26 having a flanged portion 28 are inserted into each end of cylindrical element 24. The assembled cylindrical portion and bearing elements are inserted between cylindrical elements 20 of bearing brackets 12 and 14 and retained in place by bolt 25, washers 29 and nut 30. A grease fitting 32 is provided so that the inner vacant portion may be packed with grease for lubrication. The upper portion of hinge plate 22 is bifurcated with each extending strip 34 and 36 having a cylindrical element 38 at its end.

It will be understood that a bearing bracket and a hinge plate are attached outboard of the wheels 2 on each side of the truck. A floating arm 40, preferably made of rectangular tubing, extends laterally with respect to the track, and is rotatably connected to the upper ends of the hinge plates 22. A cylindrical element 42, forming part of a hinge, is attached to the upper side of each end of floating arm 40. Bearing elements 44 having flanges 46 are inserted into each end of cylindrical element 42. Cylindrical element 42 with its bearings 44 is inserted between cylindrical elements 38 of hinge plate 22, and is retained in place by bolt 48, washers 50 and nut 52. A grease fitting 54 is provided on cylindrical element 42 so that the inner vacant space may be packed with grease for lubrication.

Attachment plates 56, which are identical, are welded to floating arm 40 near each end thereof. Attachment plates 56 are wider than floating arm 40, with the overhang 58 extending forward. In each overhang 58 there is a slot 60 for bolts. Applicator adaptors 62 and 63 are mirror images of each other, and each comprises three plates arranged in the form of a triangle as viewed from the front. Plate 64 has bolt holes 66 for attachment to attachment plate 56 by means of bolts 55, washers 57 and nuts 59. Plate 68 serves to locate the lower end of applicator plate 70 which must be angled toward the wheel 2. A height plate 72 for shimming purposes may be used between attachment plate 56 and plate 64. Applicator plate 70 has bolt holes 73 for attachment of the lubrication stick applicator 74. Lubrication stick applicator 74 has studs 76 projecting therefrom and is secured to applicator plate 70 by means of nuts 78 and washers 80.

The lubrication stick 82 and the lubrication stick applicator 74 are purchased items. Lubrication stick applicator 74 comprises a rectangular steel tube 84 having a rectangular opening 86 in one of the wider sides for insertion of the lubrication stick 82. Two lengths of coiled spring steel 88 and 90 are secured at one end of tube 84 by rivets or screws 92. The other end of the coil springs are attached to spindle 94. When there is no lubrication stick in lubrication stick applicator 74, the springs are located at or near the attachment point rivets or screws 92. A pull guide 96 is attached to the spindle. In order to load the lubrication stick applicator 74, the pull guide 96 is pulled most of the way through tube 84, thereby uncoiling and stressing springs 88 and 90. The lubrication stick 82 is inserted into rectangular opening 86. When pull guide 96 is released, springs 88 and 90 coil up, and urge lubrication stick 82 into wheel crotch 8, where it will apply a stripe of lubricant to flange 6 and crotch 8, and thence to the track.

The journal boxes to which bearing brackets 12 and 14 are attached are always the same distance apart. The wheels 2 are always the same distance apart. The hinge plates and the floating arm to which the lubrication stick applicators are attached enable the mounting to adapt to the lateral play between the wheel-axle assembly and the bearings within the journal boxes, and to apply consistently a stripe of lubrication to the flange 6 and crotch 8 of wheels 2.

While this invention is susceptible of embodiment in different forms, the drawings and the specification illustrate the preferred embodiment of the invention, with the understanding that the present disclosure is to be considered an exemplification of the principles of the invention, and the disclosure is not intended to limit the invention to the particular embodiment described.

We claim:

1. A railroad wheel flange lubricator mounting comprising:

a locomotive truck having at least one axle with flanged railroad wheels, and with axle ends contained within journal boxes;

two solid lubricator sticks, each within a lubricator stick applicator, said applicators having springs urging the lubricator stick against the flange of each of the wheels;

a floating arm parallel to the axle, with one of said applicators attached to the floating arm near each end thereof, means for attaching the lubrication stick applicator to the floating arm comprising:

an attachment plate welded to an uppermost side of the floating arm, said plate being wider than the floating arm, thus forming an overhang;

said attachment plate overhang having a slot therein;

a triangular bracket formed of three plates, said bracket bolted to the attachment plate with the apex of the bracket lowermost;

an outboard plate of the triangular bracket being pointed toward the flange of a wheel, and having holes therein for bolting to the lubrication stick applicator; and a height plate for shimming purposes inserted between the attachment plate overhang and the triangular bracket; two bearing brackets, with one attached to each journal box and extending upward therefrom; and a means to accommodate lateral motion between the axle-wheel assembly and the journal boxes, while keeping the lubricator stick in contact with the wheel flanges, said means comprising two hinge plates, each having a first end and a second end, and each rotatably attached at the first end to the upper end of one of the bearing brackets, and each rotatably attached at the second end to opposite ends of the floating arm.

* * * * *